United States Patent [19]

Stanard

[11] 4,342,167

[45] Aug. 3, 1982

[54] SELF-MOUNTING DISPLAY CALENDAR

[76] Inventor: Michael Stanard, 402 Lee St., Evanston, Ill. 60202

[21] Appl. No.: 210,313

[22] Filed: Nov. 25, 1980

[51] Int. Cl.[3] ..... G09D 3/04; G09F 1/08

[52] U.S. Cl. ..... 40/121; 40/120; 40/538

[58] Field of Search ..... 40/107, 121, 120, 594, 40/538, 539

[56] References Cited

U.S. PATENT DOCUMENTS

| | | | |
|---|---|---|---|
| 1,807,442 | 5/1931 | Schwartz | 40/594 |
| 1,836,626 | 12/1931 | Stevens | 40/121 |
| 1,887,946 | 11/1932 | Sanders | 40/539 |
| 2,016,129 | 10/1935 | Williamson | 40/539 |
| 2,755,576 | 7/1956 | Golden | 40/121 |
| 3,419,011 | 12/1968 | Norris | 40/121 X |
| 3,991,495 | 11/1976 | Wilson | 40/594 |

FOREIGN PATENT DOCUMENTS

| | | | |
|---|---|---|---|
| 1277808 | 9/1968 | Fed. Rep. of Germany | 40/121 |
| 1289565 | 11/1962 | France | 40/121 |
| 165512 | 11/1933 | Switzerland | 40/121 |
| 190438 | 4/1937 | Switzerland | 40/121 |

*Primary Examiner*—Gene Mancene
*Assistant Examiner*—Michael J. Foycik
*Attorney, Agent, or Firm*—John H. Shurtleff

[57] ABSTRACT

A self-mounting display calendar made of a multisheet paper pad having an upper mounting portion contained in a lightweight casing which is a packaging replica bearing distinctive indicia of a package design, e.g. serving as an advertising display, and a lower detachable portion on which calendar dates are printed, the two portions being separable along a tear line formed by two opposing edge notches and a number of two-dimensional perforations which occupy a major part of the tear line between the notches, a double-faced adhesive mounting being attached to the outer back side of the combined pad and casing. The resulting display device is readily mounted on a vertical surface with sufficient adhesive strength to resist the weight of the device and the force needed to detach each paper sheet bearing a calendar date.

8 Claims, 9 Drawing Figures

SELF-MOUNTING DISPLAY CALENDAR

BACKGROUND OF THE INVENTION

A calendar or calendar pad provides one of the most effective advertising devices as a business premium or gift, simply because it remains in view to the user throughout the entire year. However, such gift calendars are ordinarily used only in the home or individual offices and are seldom viewed by more than just a few people over the entire year of use.

The ideal calendar usage for advertising purposes would be in a public place, especially retail stores, supermarkets and the like, where the advertising message would be viewed by hundreds or thousands of persons every day throughout the year. On the other hand, such locations tend to be ignored for the use of calendars because there is very little space or room to place a calendar where it will actually be seen or used. And the advertising message is ordinarily just a printed picture or printed message on the flat calendar pages, so that it must compete with a large number of similar advertising pieces as well as the goods themselves in any store. Large calendar pads exhibiting one date at a time are difficult to display under these circumstances and do not lend themselves to combinations with advertising materials.

One object of the present invention is to provide a self-mounting display calendar which can be easily and securely placed on any vertical surface such as the side of a cash register or other structural member located at a checkout station in any store. Another object of the invention is to provide a display calendar which is partly housed or encased in a replica of the product being advertised, e.g. a cigarette package, liquor container, candy box or similar merchandise, such that each day's date is clearly visible immediately below the package or casing and can be detached from day to day. This arrangement serves to attract customer attention to the advertised product, especially while waiting in line and as an aid to writing checks with the correct date.

These and other objects and advantages of the invention will become more apparent upon consideration of the following summary and detailed description of a number of preferred embodiments of the invention.

SUMMARY OF THE INVENTION

It has now been found, in accordance with the invention, that a calendar device of the kind having individual detachable pages can be advantageously combined with a packaging replica or any artistic casing or housing member in order to provide a self-mounting display calendar which includes: (a) a substantially rectangular calendar pad of multiple paper sheets bound at their top end and presenting a face side, a back side and two opposing edges, said pad having an upper mounting segment and a lower printed segment separable from each other along a tear line provided in an intermediate perforated segment of the pad between notches in each of said edges, said tear line being formed by two-dimensional perforations which are sufficient in number to remove substantially more than one-half the paper as measured along the tear line between the notches; (b) a lightweight casing which is a packaging replica bearing distinctive indicia of a package design, said casing being mounted over the top end of said pad and extending downwardly around the face and back sides and two edges of the pad to a position overlapping the intermediate perforated segment while leaving the lower printed segment exposed, said casing being adhered to at least a portion of the front and back sides of the pad; and (c) a double-faced adhesive mounting means on the outer back side of the combined pad and casing with sufficient strength per unit area to self-mount and hold the pad and casing onto a flat, vertical supporting surface against the total weight of the pad and casing and also against the force needed to detach one paper sheet from the pad.

The notches which are oppositely disposed from each other in the edges of the pad may be formed as a V-shaped indentation with the innermost recess or point of the V being on the tear line or preferably may be formed as an arcuate indentation, e.g. a semicircular or rounded tip of a U-shaped recess, again with the innermost portion of the recess falling approximately on the tear line. The two-dimensional perforations are preferably circular holes which are easily bored through the pad but which may also be diamond-shaped holes or other shapes which can be die cut or punched in the paper stock before or after the pad is assembled. Combinations of different shapes of these two-dimensional perforations may also be used. It is especially useful to form at least part of the tear line by linearly piercing the paper sheets along the tear line, i.e. to provide a substantially linear or one-dimensional perforation without removing any paper.

In a particularly preferred embodiment of the invention, a lightweight and at least partly hollow mounting block is fastened to the upper end of the pad and adhered together with the pad to the casing.

While various double-faced adhesive mounting means may be used to hold the display device on a vertical surface, an adhesive coated or impregnated foam sheet material, e.g. a polyurethane or elastomeric foam material, is especially advantageous.

THE DRAWINGS

The invention is illustrated by way of example in the accompanying drawings in which.

Figure 6:
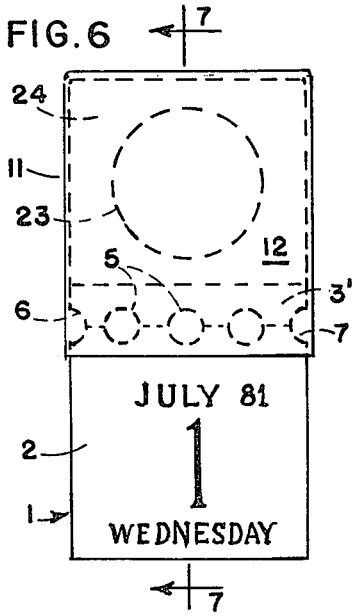
FIG. 6 is a front plan view of another embodiment of an assembled self-mounting display calendar of the invention after it has been mounted in a display position and about half of the printed segments detached.
Figure 7:
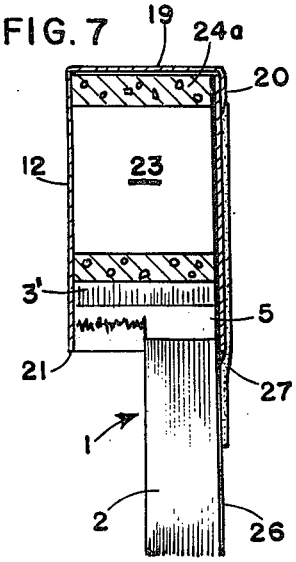
FIG. 7 is a sectional view of a display device taken on line 7—7 of FIG. 6.
Figure 8:
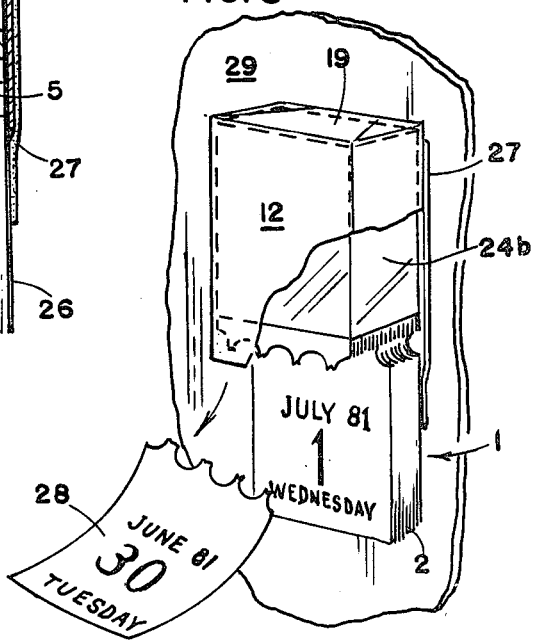
Figure 9:
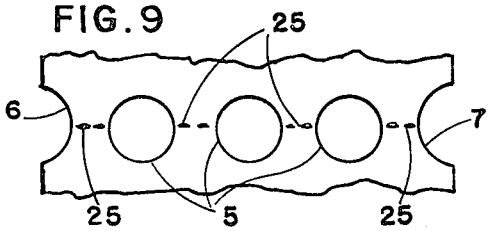

FIG. 8 is a front perspective view of a display device identical or similar to that shown in FIGS. 6 and 7, mounted on a flat, vertical surface with part of the casing cut away and with one calendar sheet being just detached; and FIG. 9 is a partial front plan view of an especially preferred calendar pad of the invention in which both one-dimensional and two-dimensional perforations are combined with edge notches to product a single tear line.

DESCRIPTION OF THE PREFERRED EMBODIMENTS

Figure 1:
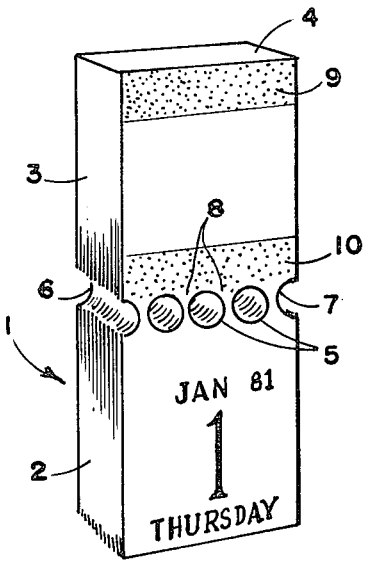
FIG. 1 is a front perspective view of one embodiment of a paper calendar pad according to the invention, prior to its assembly with a casing and an adhesive mounting means.
Figure 2:
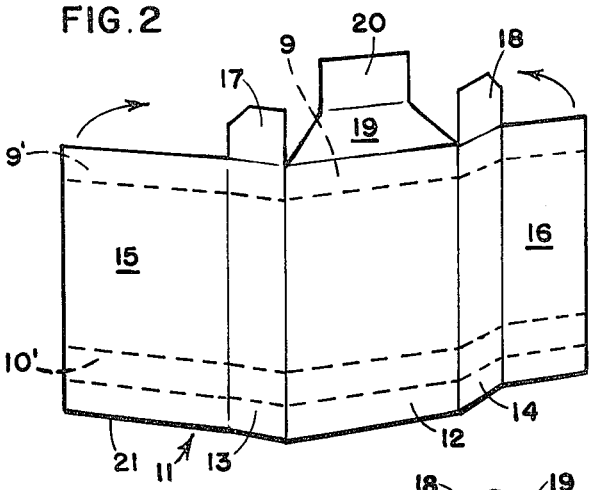
FIG. 2 is a folded out view of a cardboard casing adapted to fit closely around the upper end of the pad shown in FIG. 1.
Figure 3:
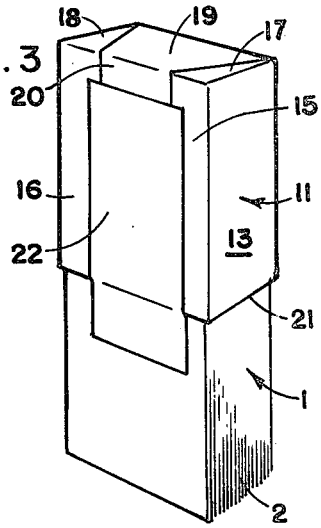
FIG. 3 is a rear perspective view of the assembled pad and casing of FIGS. 1 and 2, illustrating the preferred position of an adhesive mounting means.

Referring first to FIGS. 1–3, the paper calendar pad 1 is rectangular or an oblong prism in shape and composed of a large number of paper sheets to provide a lower printed segment 2 on which the date appears and an upper mounting segment 3 which is bound at its upper end 4, preferably with a so-called "perfect binding", in order to hold the individual sheets in place during assembly into a display device. Circular bores 5 are made through the pad 1 in order to provide circular perforations in each paper sheet along a tear line extending between the two oppositely disposed edge notches 6 and 7, these circular perforations being two dimensional so that a substantial portion of the paper along the tear line is removed, i.e. completely bored or punched out, leaving only a narrow bridge of paper 8 remaining between each perforation and the edge notches. Thus, at least half and preferably about two-thirds or more of the paper is removed as measured along the tear line or narrowest portion of the bridges 8.

In general, a circular perforation should have a diameter of at least about ¼-inch up to as high as ¾-inch, depending upon the size of the display pad. The edge notches may be smaller than, the same size as or preferably somewhat larger than the perforations, e.g. about ⅜ inch up to 1 inch when arcuate in shape. The pads will usually contain at least 260 sheets (weekdays only) with a minimum length, width and depth of about 4½, 1½ and ¾ inches, respectively. In the device of FIGS. 1–3, the perforations have a diameter of about ⅜-inch and the notches have a diameter of about ½ inch, using a pad which contains about 315 sheets (Saturdays and Sundays being combined on one sheet) and which measures about 6⅛ inches long, 2⅛ inches wide and ⅞ inches thick. The paper itself is a white, opaque stock having a weight of about 35 lbs.

While there is some choice in the size, type and weight of the paper, it is desirable to use a weight of paper which is less than 45 lbs. and especially less than 40 lbs. but still sufficiently opaque and strong in order to receive printing inks well without bleeding or penetrating, to tear evenly and to withstand constant use for a period of one year. The adoption of a relatively good quality paper is possible only by providing the large two-dimensional perforations and edge notches in the manner required according to the invention. These features are essential to give a clean tear line while still limiting the force needed to detach a single sheet.

In order to securely attach the pad 1 of FIG. 1 to the casing member 11 of FIG. 2, it is desirable to apply an adhesive film or a double-faced cellophane or plastic adhesive tape to the shaded areas 9 and 10 on the front and back sides of the pad. The corresponding areas 9' and 10' are indicated by dotted lines extending around the inner surfaces of the cardboard casing 11. This casing 11 has a front wall 12, two side walls 13 and 14 and overlapping back walls 15 and 16, preferably with wall 16 being folded over on top of wall 15 and adhered thereto in the final assembled box structure of the casing. The two top ears 17 and 18 are folded down over the top end 4 of the pad 1, and the end flap 19 with tab 20 is then folded over the top and partly down the back side of the casing as further shown in FIG. 3. The lower end or edge 21 of the casing 11 overlaps and preferably completely covers the perforations 5 and edge notches 6 and 7 of the pad 1, thereby hiding these portions from view and maintaining a clean or neat appearance even when calendar sheets have been detached. The cardboard for the casing should also be selected for lightness and strength, e.g. using about a 10 point to 20 point cardboard, preferably plastic coated on the outer surface and an easily adhered inner wall surface.

One can apply adhesive over all of the surfaces of the upper mounting segment 3 of the pad 1, including the top end 4, but it has been found to be sufficient to adhere only part of the front and back sides as indicated by bands 9 and 10 in FIG. 1 or to apply adhesive strips to the inside walls of the casing as indicated in FIG. 2 at 9' and 10'. Again, the object is to provide adequate bonding strength while keeping the weight of the display unit as low as possible.

It is quite critical to use a strong double-faced adhesive mounting means 22 applied to the back side of the date pad and casing, a thin foam adhesive strip having been proven to give the necessary adhesive strength per unit surface area to hold the display unit in place on a vertical surface. In the embodiment shown in FIGS. 1–3, the adhesive strip measures about 4 inches long by 1½ inches wide and has a thickness of less than 1/32 inch. Such strips not only yield a high strength of adhesion but can also be applied to a wide variety of surfaces and still be removed again after one year with minimal cleaning or resurfacing of the supporting surface.

Figure 4:
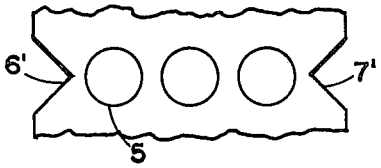
FIGS. 4 and 5 are partial front plan views of the intermediate perforated segments of the calendar pads of the invention, illustrating different configurations of the edge notches and two-dimensional perforations which form the individual tear lines.
Figure 5:
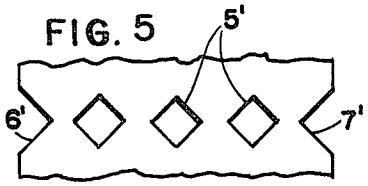

As shown in FIGS. 4 and 5, one can use different shapes and sizes of notches 6' and 7' and two-dimensional perforations 5 or 5', although the use of the circular holes 5 is especially desirable since they can be drilled through the entire pad in one operation, including the notches if the ads are cut to size from one large pad along a line which passes through the center of the holes forming the notches of adjacent pads. Alternatively, individual preprinted sheets or a small group of sheets having a plurality of impressions of the same date page can be run through a die punching machine to cut or punch out the perforations and notches, after which the papers can be assembled into pads of the desired thickness for cutting to the size of the individual pads.

The notch on each edge of the pad should always be formed in order to gradually taper inwardly to the tear line, i.e. so that the pulling force will be directed toward the weakest beginning point of the tear line. Likewise, the perforations should gradually reach their widest dimension on the tear line, regardless of their individual shape, thereby providing paper bridges between the two-dimensional perforations and the edge notches, these bridges narrowing or necking down to their smallest lateral dimension on the tear line.

As shown in FIG. 9, taken with FIGS. 6, 7 and 8, especially good results are achieved if the circular two-dimensional perforations are combined with the linear one-dimensional perforations 25 which are made in a conventional manner so as to pierce the paper without actually removing any substantial amount of paper from each sheet. Such linear perforations are not satisfactory when used alone as a tear line but do enhance the result obtained with the two-dimensional perforations. Moreover, an improved result is achieved even if the linear perforation is inadvertantly located some distance above or below the "ideal tear line", defined as the line extending transversely through the center points of the two-dimensional perforations or as the transverse line containing the least amount of paper.

The embodiment as fully illustrated in FIGS. 6–8 has the advantage of being substantially lighter in weight by removing a substantial portion of the upper mounting segment of the pad 1, including a large hole 23 drilled from the pad itself as suggested by FIG. 6. The preferred embodiment as actually shown is one in which the size of the pad 1 is reduced to provide only a short mounting segment 3' which is then firmly glued or otherwise fastened at its upper end to an at least partly hollow block 24 which may contain a large hole 23 and/or may be constructed of a foamed plastic or elatsomeric material **24*a* (FIG. 7) having voids or cells (open or closed) to reduce its weight. Any number of moldable thermoplastic or thermosetting polymers can be used to make this block 24 which is preferably substantially lighter than the paper pad cut to the same size or dimensions. A thin-walled, six-sided plastic box 24*b* provides a substantially completely hollow block as a very good filler member (indicated by FIG. 8**).

Very little additional adhesive is needed to assemble the pad/block unit of FIGS. 6–8 since the perfect bound pad already contains an adhesive material on its top surface and only another thin layer of a compatible adhesive is required to join and firmly unite the block 24 with the pad 1. It is desirable to adhere the upper segment 3' of the pad to the interior walls of the casing as well as adhering the block 24 directly to the casing or indirectly to the casing by means of a paper or cardboard insert 26 which may also serve as the last page of the pad 1. Such variations in structure can be carried out within the scope and spirit of the invention as defined by the claims below.

The fully assembled unit is self-mounted by means of a foam adhesive pad 27 which in FIG. 9 extends over almost the entire width of the unit from a point just below the top 19 of the casing down to and over a portion of the last page of the pad represented by insert 26. When mounted in this manner, the individual date pages such as 28 are easily detached along the transverse tear line formed by circular perforations or cutouts 5, the notches 6 and 7, and preferably the linear perforations 25 (FIG. 9).

The various embodiments of the invention have individual parts which are relatively simple to manufacture and assemble into a single display unit having only two main visible parts, i.e. the printed segment 2 of each calendar page and the outer casing which is made to resemble the product being advertised. An additional advertising message can also be placed on each calendar page, e.g. above or below the printed date. The casing is preferably an approximately 14 point cardboard material which has been plastic coated, but other paperboard stocks or plastic sheet materials may also be used alone or in combination to form an attractive, lightweight outer casing as a decorative housing or advertising replica.

When mounted on a vertical surface 29, preferably a cash register or similar machine or other supporting surface, the adhesive mounting means is sufficiently large in area and offers enough adhesive strength to hold the display unit for an indefinite period of time in the desired location.

The invention is hereby claimed as follows:

1. A self-mounting display calendar comprising:

a substantially rectangular calendar pad of multiple paper sheets bound at their top end and presenting a face side, a back side and two opposing edges, said pad having an upper mounting segment and a lower printed segment separable from each other along a tear line provided in an intermediate perforated segment of the pad between notches in each of said edges, said tear line being formed by two-dimensional perforations which are sufficient in number to remove substantially more than one-half the paper as measured along the tear line between the notches;

a lightweight casing which is a packaging replica bearing distinctive indicia of a package design, said casing being mounted over the top end of said pad and extending downwardly around the face and back sides and two edges of the pad to a position overlapping the intermediate perforated segment while leaving the lower printed segment exposed, said casing being adhered to at least a portion of the front and back sides of the pad; and a double-faced adhesive mounting means attached to the outer back side of the combined pad and casing with sufficient strength per unit area to self-mount and hold the pad and casing onto a flat, vertical supporting surface against the total weight of the pad and casing and also against the force needed to detach one paper sheet from the pad.

2. A self-mounting display calendar as claimed in claim 1 wherein said two-dimensional perforations remove approximately at least two-thirds of the paper as measured on the tear line between the notches.

3. A self-mounting display calendar as claimed in claim 2 wherein said two-dimensional perforations are circular holes centered approximately on said tear line between the notches.

4. A self-mounting display calendar as claimed in claim 3 wherein said two-dimensional perforations are circular holes having a diameter of between about $\frac{1}{4}$-inch and $\frac{3}{4}$-inch.

5. A self-mounting display calendar as claimed in claim 1, 2, 3 or 4 wherein each notch is an arcuate indentation in the edge of the pad.

6. A self-mounting display calendar as claimed in claim 1, 2, 3 or 4 wherein each notch is a V-shaped indentation in the edge of the pad.

7. A self-mounting display calendar as claimed in claim 1, 2 or 3 wherein a part of the tear line is formed in part by said two-dimensional perforations and in part by linearly piercing the paper sheets in the unremoved portions of said tear line.

8. A self-mounting display calendar as claimed in claim 1 including an at least partly hollow block, lighter in weight than the paper pad when cut to same size, said block being fastened to the upper end of the pad and adhered together with the pad to said casing.

* * * * *